United States Patent [19]

Reid

[11] 4,342,131

[45] Aug. 3, 1982

[54] FIREPLACE CLEANER

[76] Inventor: Janet G. Reid, 51646 Lakeland Dr., Elkhart, Ind. 46514

[21] Appl. No.: 187,500

[22] Filed: Sep. 15, 1980

[51] Int. Cl.[3] ..... A47L 5/36

[52] U.S. Cl. ..... 15/327 D; 15/352; 15/401

[58] Field of Search ..... 15/352, 353, 401, 327 D

[56] References Cited

U.S. PATENT DOCUMENTS

| | | | |
|---|---|---|---|
| 2,531,920 | 11/1950 | Raminger | 15/422 X |
| 3,180,071 | 4/1967 | Nolte | 15/353 X |
| 3,343,199 | 9/1967 | Nolte | 15/352 X |
| 3,358,316 | 12/1967 | Okun | 15/352 |

FOREIGN PATENT DOCUMENTS

| | | | |
|---|---|---|---|
| 58617 | 4/1941 | Denmark | 15/401 |
| 2351769 | 9/1974 | Fed. Rep. of Germany | 15/352 |

*Primary Examiner*—Chris K. Moore
*Attorney, Agent, or Firm*—Marmaduke A. Hobbs

[57] ABSTRACT

A fireplace cleaner having a container made of heat-resistant material is supported on a mobile base frame. A removable housing supporting a suction pump thereon is releasably attached to the base frame while completely surrounding and enclosing the container. The housing also has a suction conduit ending in a scoop-like suction nozzle attached to the side thereof, and opening into the interior of the housing above the top of the container. A heat-resistant filter is disposed between the interior of the container and the suction pump.

9 Claims, 2 Drawing Figures

FIREPLACE CLEANER

BACKGROUND OF THE INVENTION

Since centralized forced air, water and steam heating systems have become widely available, the use of fireplaces has declined, being limited mainly to decorative installation for only occasional use. With the rapid increase in the cost of fuels such as natural gas, coal and oil, homeowners have looked for alternate heating fuels and systems which are less expensive than the fossil fuels. Further, many homeowners have become concerned about fuel availability as well as cost, and have sought alternative fuels and systems as backup heat sources in the event that oil or gas shortages cause rationing or other decreased fuel supply. People have become reaware of the benefits of wood heating systems. Wood is a renewable resource, presently in wide availability and under forestry supply management to ensure continued availability. In the forested regions of the country, wood is available at less cost than the fossil fuels, and often can be obtained free by those willing and able to cut and haul it themselves. The lower cost and unlimited supply of wood, if properly managed, has caused many people to return to the use of fireplaces as primary or backup residential heat sources. Fireplaces are therefore regaining the popularity they once had as heat sources for homes.

Designers and builders have improved fireplace efficiency over that of the decorative fireplaces commonly used in the past. Many different types of heat circulating units, either of the integral type installed into the fireplace, or of the add-on type for use on older fireplaces, are available. Improved grates and draft control devices are marketed. One aspect of fireplace use has not, however, received as many improvements. Cleaning of fireplaces most often is still performed substantially as it has been since fireplaces were first put in homes. The ash is shoveled or scooped from the fireplace, put into a container and carried from the room. This cleaning procedure is very time consuming, especially if a large amount of ash is present in the fireplace. When fireplaces are used only occasionally, for decorative purposes, the ash removal can be done when sufficient time is available, and can be delayed until time is available. However, if the fireplace is being used as a primary and continuous heat source, regular ash removal is required, usually on a daily basis. Often it is inconvenient to remove the ashes when the accumulation thereof requires their removal. Further, the shoveling of ashes creates substantial amounts of dust which can circulate into the room, soiling the floor and furniture therein. Thus, great care and even more time are required to minimize the mess resulting from fireplace cleaning.

A further problem relating to fireplace cleaning is now present, resulting from the fact that many people use their fireplaces continuously throughout the day, to provide supplemental heat to their homes. When the fireplace is cleaned, burning coals and embers are present, and the ash is hot. Accidental spillage of a scoop full of hot ash or embers can result in injury to the person as well as scorched or burned carpets and floors. The area directly in front of the fireplace is quite warm, and the tedious, time consuming scooping of the ashes from the fireplace can become most uncomfortable. To avoid the mess and discomfort which result when the fireplace is cleaned, many people have chosen to forego more than just occasional use of their fireplaces, even though they desire to avail themselves of the benefits of more frequent fireplace use.

As an alternative to a fireplace, many people have installed and use Franklin stoves and barrel stoves in homes or have added wood burning units to their existing central heating systems. The inconvenience and discomfort associated with fireplace cleaning are also present in the cleaning of these heating devices.

SUMMARY OF THE INVENTION

To overcome the aforementioned and other problems in fireplace cleaning, it is one of the principal objects of the present invention to provide a fireplace cleaner which will evacuate the ashes from a fireplace quickly and easily, and which can be used even when a fire is present in the fireplace, to clean hot ashes therefrom, thus promoting efficient fireplace use.

Another object of the present invention is to provide a fireplace cleaner which minimizes the dispersal of ash and dust into the room while also reducing the time required to clean a fireplace, and which reduces the potential for scorching or burning of the floor in the room and injury to the person cleaning the fireplace from hot ash, embers and coals.

A further object of the present invention is to provide a fireplace cleaner which includes means for transporting the ashes from the fireplace to a site for disposal without requiring heavy lifting or prolonged carrying of the ashes, and which may be used to clean barrel stoves, wood burning furnaces, Franklin stoves, barbecue pits, or the like, as well as fireplaces.

These and other objects are accomplished with the present invention by providing a heat resistant container, a vacuum generating device for the container, a fireproof or heat resistant filter disposed between the container and vacuum generating device and a conduit, such as a flexible metal tube or hose, through which the ashes and embers in the fireplace are sucked into the heat resistant container. The conduit means preferably has a shovel-like attachment for scooping the hot ash, coals and embers from a fireplace, while a fire is burning therein.

Additional objects and advantages of the present invention will become apparent from the following detailed description and the accompanying drawings.

DESCRIPTION OF THE PREFERRED EMBODIMENT

Figure 1:
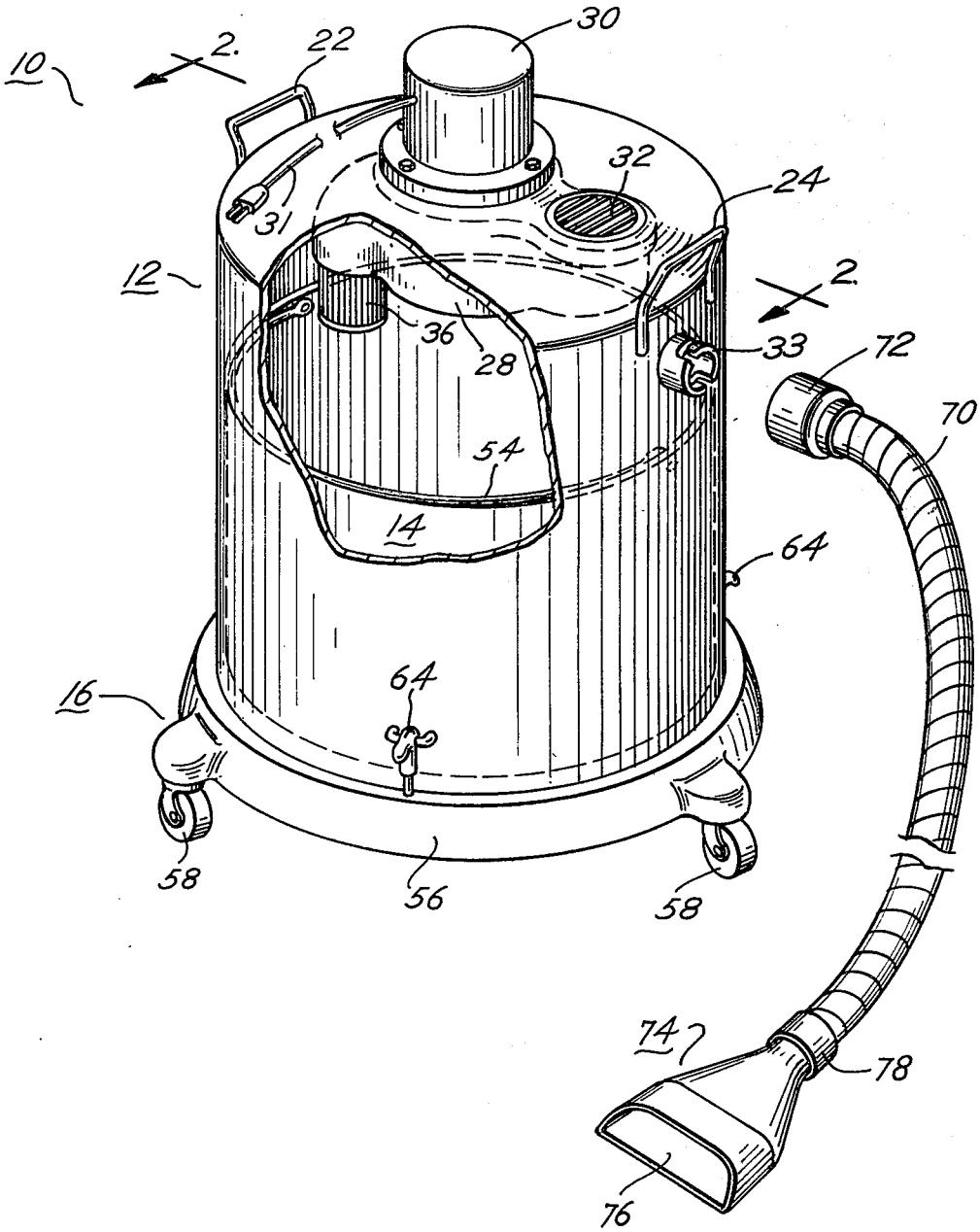
FIG. 1 is a perspective view, partially broken away, of a fireplace cleaner embodying the present invention.
Figure 2:
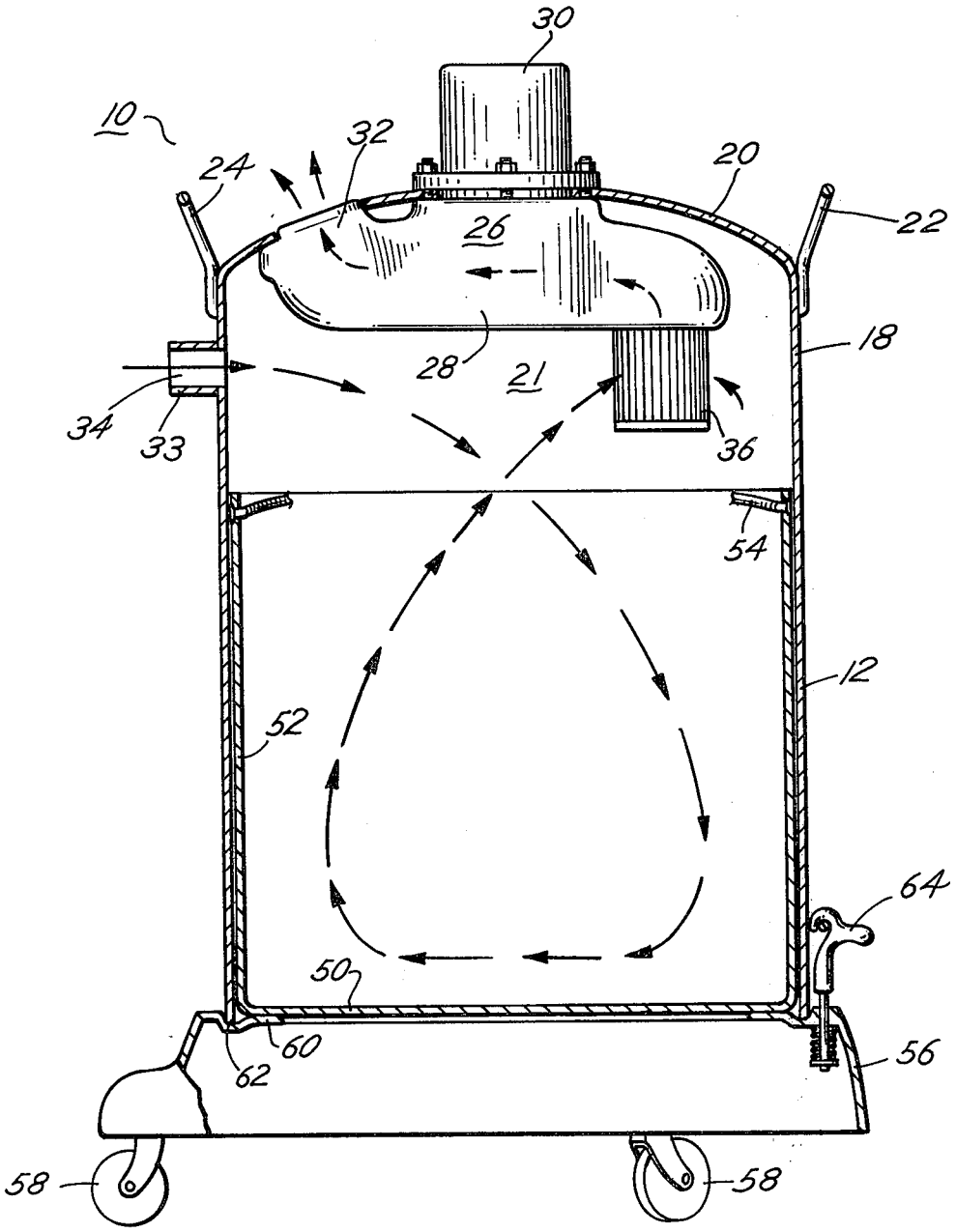
FIG. 2 is a cross sectional view of the fireplace cleaner shown in FIG. 1, taken on line 2—2 of the latter figure.

Referring more specifically to the drawings, and to FIG. 1 in particular, numeral 10 designates a fireplace cleaner embodying the present invention which may be used to clean fireplaces while a fire is burning therein and which also may be used to clean Franklin stoves, barrel stoves and other types of heating devices in which coal, wood or the like are burned. The present cleaner may also be used to clean a barbecue pit, or grill, a trash burner, or virtually any apparatus in which combustion occurs and ash accumulates.

Fireplace cleaner 10 includes an outer housing 12 and an inner metal container 14 for holding the ashes. A dolly 16 on which the assembled cleaner and/or the container holding ashes is transported is disposed under housing 12 and container 14. The outer housing, which may be of metal or other suitable fire resistant material, includes a side wall 18, a top 20, defining an enclosed area 21, and handles 22 and 24 disposed diametrically opposite each other near the top of the side wall. A vacuum generating device 26 is secured to the top 20 of outer housing 12, and includes an air suction unit 28 disposed in the upper portion of the outer housing within inner area 21, and an electric motor 30 for driving a blower or fan in the suction unit, the motor being connected to an electric power source by cord 31. An air exit port 32 from suction unit 28 is disposed in top 20 and an annular flange 33 defines an inlet port 34 opening into inner area 21 near the top of side wall 18. A filtering unit 36 communicating with inner area 21 is disposed on the end of the air inlet of suction unit 28. Vacuum generating device 26 sucks air into area 21 through inlet port 34 and discharges air filtered by filtering unit 36 through air suction unit 28 and air exit port 32. The actual filter material may be fiberglass cloth, fine mesh wire screening or other suitable porous fire resistant material.

Container 14 fits within outer housing 12 and includes a bottom 50 and a side wall 52 constructed of aluminum or other heat resistant material so that hot ashes, embers and the like may be deposited in the container without causing damage to the fireplace cleaner. The top of side wall 52 is below inlet port 34 when cleaner 10 is fully assembled. A bail 54 is attached to the container near the top thereof to provide a handle for carrying the container.

Dolly 16 includes a frame 56 with three or more casters 58 disposed thereunder on which the entire fireplace cleaner can be rolled about from a storing place to the fireplace to be cleaned, to an area for disposal of ashes, and back to the storing place. In the embodiment shown, frame 56 includes an inwardly extending flange 60 on which bottom 50 of container 14 is supported. Side wall 18 of outer housing 12 is disposed in a groove 62 of flange 60 when the cleaner is completely assembled. Three latching devices 64 are disposed around the periphery of frame 56 and are used to secure outer housing 12 to dolly 16.

A vacuum hose 70, preferably consisting of a flexible metal tube, having an attachment end 72 which secures the hose to annular flange 33 defining inlet port 34, forms a conduit through which the ashes are sucked into the interior of the cleaner. A suitable ash gathering attachment 74 is disposed on the end of vacuum hose 70 opposite attachment end 72, as shown in FIG. 1, wherein the attachment has a generally flat shovel-like design with a flat bottom 76 which may be slid on the floor of the fireplace to scoop the ashes, which will then be sucked through vacuum hose 70 into container 14. The vacuum hose and related attachment devices and ash gathering devices are also of heat resistant materials such as aluminum so that hot ashes and embers gathered thereby will not cause heat related damage to these parts. A screen may be disposed in the free end of hose 70, near the area of the hose indicated generally by numeral 78, to keep undesirably large embers or pieces of wood from being sucked into the hose and clogging the hose.

In the use and operation of a fireplace cleaner embodying the present invention, when a fireplace, barrel stove, Franklin stove, barbecue pit or the like is to be cleaned, cleaner 10 is rolled on casters 58 to the device to be cleaned. Vacuum hose 70 is attached to annular flange 33 defining air inlet port 34, cord 31 is attached to an electrical supply outlet, and vacuum generating device 26 is turned on. The vacuum generating device will exhaust air through air exit port 32, drawing the air from inner area 21, through filter unit 36 and suction unit 28. The vacuum created within area 21 by device 26 is transmitted through hose 70 and draws ashes, embers and the like through the hose and into inner area 21, where the large inner area in comparison to the hose permits the ashes, embers and the like to fall into inner container 14. Filter unit 36 prevents dust and ash from passing through suction unit 28 and air exit port 32 into the room. The vacuum created by generating device 26 will rapidly suck the ashes from the fireplace, thereby substantially reducing the time required to clean the fireplace, and will suck up the fine ash and dust which are normally difficult to pick up with scoops, shovels or brooms. Hence, the fireplace is cleaned more thoroughly with the present device than by previous methods. The heat resistant material of which hose 70 and container 14 are constructed enables hot ash, embers and coals to be evacuated from the fireplace into the present fireplace cleaner without causing heat related damage to the cleaner.

When the ash in the fireplace has been completely removed therefrom, vacuum generating device 26 is turned off and cord 31 is disconnected from the electrical supply outlet. Hose 70 may be detached from annular flange 33 and stored for future use. The remaining assembly of dolly 16, inner container 14 and outer housing 12 can be transported on casters 58 to a suitable location for disposal of the ash. Latching devices 64 are detached from outer housing 12, and the outer housing is then lifted by handles 22 and 24 from the dolly and over the top of inner container 14. The container remains on flange 60 and can be further transported if desired without the outer housing thereon. When a suitable ash pit, garbage can or other disposal site is reached, inner container 14 is lifted by bail 54 and dumped. If necessary, the inner container can be carried by bail 54 to an ash disposal site not easily reached by rolling the container on dolly 16. If made of aluminum or other light weight and heat resistant material, container 14 is easily carried by bail 54. When the hot ash and embers have been cleaned from the fireplace, it may be desirable to allow the ash and embers to remain in the heat resistant inner container 14 until they have cooled, and the danger of fire is eliminated. After the ash has been dumped from the inner container, the container is placed back on dolly 16, with bottom 50 of the container resting on flange 60. Outer housing 12 is slid over the top of the inner container and down the side walls until the bottom of the side walls are seated in groove 62. Latching devices 64 are reattached to the outer housing and the assembled structure may be stored for future use.

It is clear that many of the disadvantages of prior fireplace cleaning methods are eliminated by the present fireplace cleaner. Since the vacuum generating device will quickly evacuate the ash from the fireplace into the inner container, the person performing the fireplace cleaning need not spend extended amounts of time in front of a hot fireplace. The ash can be transported from the fireplace, across a room and through the house, while completely enclosed in the inner container, with the outer housing thereon providing a cover to the container. Hence, the ash will not fall from the fireplace cleaner into the house or onto the floor. Hot ash and embers can be sucked into the container, thus permitting fireplace cleaning while a fire burns therein, and the possibility that hot ash and embers will fall onto the floor during the cleaning process and scorch flooring or carpeting is eliminated or substantially reduced. The casters disposed under the fireplace cleaner provide a means for easily transporting the ash and cleaner.

Modifications may be made to the basic fireplace cleaner. The length of hose 70 may vary from one cleaner to another, depending upon the length most convenient for the application for which the cleaner will be used. In some instances it may be desirable to shorten side wall 18 and provide means for attaching the upper portion of the housing to the top of container 14. In this embodiment, the cleaner has only a single side wall, rather than the double side wall formed by the housing and container. Air inlet port 34 may be disposed in top 20, rather than side wall 18, and handles 22 and 24 may be located elsewhere than near the top of side wall 18. Dolly 16 can be eliminated, though use of the dolly is preferred for ease in transporting the cleaner and ashes. Alternatively, casters or wheels may be attached directly to bottom 50 of container 14.

Although one embodiment and several modifications of a fireplace cleaner have been disclosed in detail herein, various changes may be made without departing from the scope of the present invention.

I claim:

1. A fireplace cleaner comprising a base frame, a container removably supported on said frame and having a bottom and side wall of heat resistant material for receiving ashes from the fireplace, a removable housing having a top disposed over said container and side walls seated on said base frame and surrounding and enclosing said container and extending above the upper edge of said container, conduit means connected at one end to said housing above said container and communicating with the interior of said container, a scoop mounted on the other end of said conduit means and in communication therewith, and vacuum generating means secured to said top for drawing fireplace ashes from said scoop through said conduit means and depositing the ashes in said container.

2. A fireplace cleaner as defined in claim 1 in which casters are disposed under said frame for transporting said cleaner.

3. A fireplace cleaner as defined in claim 1 in which a latching means releasably secures said housing to said frame.

4. A fireplace cleaner as defined in claim 3 in which said frame has casters thereon and a flange for supporting said container.

5. A fireplace cleaner as defined in claim 1 in which said frame has casters thereon and a flange for supporting said container.

6. A fireplace cleaner as defined in claim 5 in which said flange includes a groove, and said side walls of said housing fit in said groove.

7. A fireplace cleaner as defined in claim 6 in which handles are disposed on said housing and a handle means is attached to said container for lifting said container when it contains hot ash, coals and/or embers.

8. A fireplace cleaner as defined in claim 7 in which said scoop is a shovel-like attachment disposed on the free end of said conduit means for scooping hot ash, coals and embers from a fireplace or the like.

9. A fireplace cleaner as defined in claim 1 in which said scoop is a shovel-like attachment disposed on the free end of said conduit means for scooping hot ash, coals and embers from a fireplace or the like.

* * * * *